US012797928B2

(12) United States Patent
Juengst et al.

(10) Patent No.: US 12,797,928 B2
(45) Date of Patent: Nov. 17, 2026

(54) METHOD FOR OPERATING A ROLLING LINE, AND COMPUTER PROGRAM PRODUCT FOR CARRYING OUT THE METHOD

(71) Applicant: SMS group GmbH, Düsseldorf (DE)

(72) Inventors: Stephan Juengst, Netphen (DE); Christian Mengel, Siegen (DE); Matthias Peters, Kreuztal (DE)

(73) Assignee: SMS group GmbH, Düsseldorf (DE)

( * ) Notice: Subject to any disclaimer, the term of this patent is extended or adjusted under 35 U.S.C. 154(b) by 250 days.

(21) Appl. No.: 18/713,651

(22) PCT Filed: Nov. 30, 2022

(86) PCT No.: PCT/EP2022/083788
§ 371 (c)(1),
(2) Date: May 26, 2024

(87) PCT Pub. No.: WO2023/099531
PCT Pub. Date: Jun. 8, 2023

(65) Prior Publication Data

US 2025/0010347 A1 Jan. 9, 2025

(30) Foreign Application Priority Data

Nov. 30, 2021 (DE) ..... 10 2021 213 566.8

(51) Int. Cl.
*B21B 37/16* (2006.01)

(52) U.S. Cl.
CPC ..... *B21B 37/16* (2013.01)

(58) Field of Classification Search
CPC ..... B21B 37/16; B21B 37/18; B21B 37/165; B21B 37/22; B21B 37/26; B21B 2261/04; B21B 2271/02
See application file for complete search history.

(56) References Cited

U.S. PATENT DOCUMENTS 3,762,195 A * 10/1973 Kitanosono ..... B21B 37/26 72/240
9,138,789 B2 * 9/2015 Gruss ..... B21B 35/04
(Continued)

FOREIGN PATENT DOCUMENTS

EP 2346625 A2 7/2011
EP 2428288 A1 3/2012
(Continued)

OTHER PUBLICATIONS

CN 107321800A, Peng et al. Nov. 2017.*
WO 99/24183A1, Tautz et al. May 1999.*

*Primary Examiner* — Edward T Tolan
(74) *Attorney, Agent, or Firm* — Smartpat PLC

(57) ABSTRACT

A method for operating a rolling line with rolling mill stands arranged one behind the other in the rolling direction, for the rolling of rolling material from a previous final rolling dimension to a changed new final rolling dimension is disclosed. According to the method, the rolling is carried out in two temporal phases I and II. In the first temporal phase, the rolling is carried out with a first load redistribution with known wedge-on-wedge rolling. In the first load redistribution the last rolling mill stand maintains its previously set gap unchanged. To shorten a transition time and wedge length during a transition, the rolling mill stands drive pass changes in accordance with a second load redistribution. The second load redistribution, differently than in the first temporal phase I, dynamically drives the last rolling mill stand to the new final rolling dimension.

15 Claims, 6 Drawing Sheets

(56) References Cited

U.S. PATENT DOCUMENTS

| | | | | |
|---|---|---|---|---|
| 9,314,828 | B2 * | 4/2016 | Grüss | B21B 37/26 |
| 9,364,878 | B2 * | 6/2016 | Ritter | B21B 37/58 |
| 2011/0289993 | A1 | 12/2011 | Gruess et al. | |
| 2018/0191420 | A1 | 7/2018 | Kutz et al. | |

FOREIGN PATENT DOCUMENTS

| | | | |
|---|---|---|---|
| EP | 3346625 | A1 | 7/2018 |
| JP | S59178113 | A | 10/1984 |
| WO | 9924183 | A1 | 5/1999 |
| WO | 2010049280 | A2 | 5/2010 |
| WO | 2012034875 | A2 | 3/2012 |

* cited by examiner old wedge-on-wedge method
prior art

| | F1 | F2 | F3 | F4 | F5 | |
|---|---|---|---|---|---|---|
| wedge length exit at 50% reduction F1-F5 | 1 | 2 | 4 | 8 | 16 | m |
| starting exit thickness | 16 | 8 | 4 | 2 | 1 | mm |
| | | | | | | |
| prior art wedge-on-wedge | 12,8 | 6,4 | 3,2 | 1,6 | 0,8 | mm |
| Delta | 3,2 | 1,6 | 0,8 | 0,4 | 0,2 | mm |

example extreme case 1

| | F1 | F2 | F3 | F4 | F5 | |
|---|---|---|---|---|---|---|
| exit wedge length | | | | | 0,5 | m |
| starting exit thickness | 16 | 8 | 4 | 2 | 1 | mm |
| Phase I exit thickness | 12,8 | 6,4 | 3,2 | 1,6 | 1 | mm |
| Phase II exit thickness | 12,8 | 6,4 | 3,2 | 1,6 | 0,8 | mm |
| Delta Phase I | 3,2 | 1,6 | 0,8 | 0,4 | 0 | mm |
| Delta Phase II | 0 | 0 | 0 | 0 | 0,2 | mm |

example extreme case 2

| | F1 | F2 | F3 | F4 | F5 | |
|---|---|---|---|---|---|---|
| exit wedge length | 0,5 | 1 | 2 | 4 | 8 | m |
| starting exit thickness | 16 | 8 | 4 | 2 | 1 | mm |
| Phase I exit thickness | 14 | 7 | 3,5 | 1,7 | 1 | mm |
| Phase II exit thickness | 12,8 | 6,4 | 3,2 | 1,6 | 0,8 | mm |
| Delta Phase I | 2 | 1 | 0,5 | 0,3 | 0 | mm |
| Delta Phase II | 1,2 | 0,6 | 0,3 | 0,1 | 0,2 | mm |

legend

- value remains constant
- target thickness
- intermediate thickness

Fig. 5

METHOD FOR OPERATING A ROLLING LINE, AND COMPUTER PROGRAM PRODUCT FOR CARRYING OUT THE METHOD

CROSS-REFERENCE TO RELATED APPLICATION

This application is a national stage application, filed under 35 U.S.C. § 371, of International Patent Application PCT/EP2022/083788, filed on Nov. 30, 2022, which claims the benefit of German Patent Application DE 10 2021 213 566.8, filed on Nov. 30, 2021.

TECHNICAL FIELD

The disclosure relates to a method and a computer program product for operating a rolling line having a total number of M rolling mill stands, arranged one behind the other in the rolling direction, for the rolling of rolling material, in particular metal strip, from a previous final rolling dimension to a changed new final rolling dimension.

BACKGROUND

If a final rolling dimension of the rolling material is to change, an optimum wear distribution of the individual rolling mill stands along with an optimum quality of the rolling material can only be ensured with a suitable recalculated load redistribution for the individual rolling mill stands of a rolling line and with a correspondingly newly set roll gap. The transition to the new final rolling dimension is usually carried out in a fixed portion of the rolling material, i.e. a so-called virtual strip portion. This strip portion is tracked through the entire rolling line and each rolling mill stand changes the size of its roll gap in exactly this same strip portion in accordance with the specified load redistribution. Wedges are then formed in the rolling material during rolling. These are transition regions in which the thickness or width of the rolling material changes from a previous final rolling dimension to a new final rolling dimension.

If all of the rolling mill stands involved in the rolling line approach the pass changes provided for them as part of the load redistribution, i.e. the new sizes of their roll gaps, at the same time, this can lead to mass flow problems. In order to keep such mass flow problems to a minimum, the desired change in the final rolling dimension is traditionally carried out as follows: Each rolling mill stand of the rolling line rolls a wedge in the rolling material/strip portion in such a manner that, in each case, such wedge starts in the rolling material at the point where the previous rolling mill stand in each case started rolling it (wedge-on-wedge). This method is described, for example, in the European patent specification EP 2 346 625 B1.

Such so-called "wedge-on-wedge rolling" has a disadvantage when used with an endless length of rolling material, via which a casting machine, in which the rolling material is cast, and the rolling line, in which the rolling material is to be subsequently rolled, are coupled together. This consists of the fact that, due to the specified coupling to the casting machine, not only the transport speed of the rolling material is favored by the rolling mill stands. Additionally, the adjusting cylinder traverse speed, particularly of the first rolling mill stands in the rolling line, must also be artificially limited. The reason for this necessary limitation lies in the following facts:

The higher the adjusting cylinder traverse speed, i.e. in particular the speed at which the roll gap, for example, is closed, the higher the exit speed and the acceleration of the rolling material from the rolling mill stand, because the mass flow must remain constant. The higher the exit speed, the higher the entry speed of the rolling material into the subsequent rolling mill stand. I.e.: The work rolls of the subsequent rolling mill stand would then have to be able to accelerate correspondingly rapidly in order to cope with the higher entry speed of the rolling material. However, because the acceleration capacity of the work rolls of a rolling mill stand is limited, loopers are typically used in the intermediate rolling mill stand regions of a finishing rolling line, which temporarily store/buffer the material exiting a previous rolling mill stand until the work rolls of the following rolling mill stand have accelerated to such an extent that they can roll the more rapid entering material at the required rolling speed. However, if the adjusting cylinder traverse speed of the preceding rolling mill stand is too high, it can occur that both the acceleration capacity of the work rolls of the following rolling mill stand and the capacity of the looper are no longer sufficient to process the very rapidly entering rolling material; this inevitably leads to an upsetting/"blow-ups" of the rolling material in the rolling line. In order to prevent such a situation, the adjusting cylinder traverse speed must be sufficiently limited, i.e. it is usually well below the maximum adjusting cylinder traverse speed that would be technically possible for the rolling mill stand.

The artificially reduced adjusting cylinder traverse speed-again due to the necessarily constant mass flow-results in a very long wedge in the rolling material, in particular at the outlet of the last rolling mill stand, although such last rolling mill stand could certainly open or close more rapidly due to its technology. The long wedge means a long transition time and a long strip portion in which the transition to the new desired final dimension is carried out. The wedge in the rolling material is usually scrap/lost material.

In the prior art, the long wedge and the long transition time result from the procedure that the desired final dimension is realized in only one single temporal phase by pure wedge-on-wedge rolling. The underlying load redistribution also includes a pass change for the last rolling mill stand.

With regard to an increase in production throughput and a reduction of the amount of lost material, it makes sense to implement a planned change in the final rolling dimension within a shorter transition time and on the shortest possible strip portion of the rolling material.

SUMMARY

The present disclosure based on the object of further developing a known method and a known computer program for operating a rolling line in such a manner that a change in the final rolling dimension of the rolling material is carried out within a shorter transition time and is limited to as short a portion of the rolling material as possible.

This object is achieved by the method as disclosed herein. It is characterized in that in the first load redistribution for the last of the M rolling mill stands, no pass change is provided; and it is further characterized by the following steps:

- determination of a second load redistribution for a second temporal phase in the form of second pass changes for at least the last rolling mill stand with regard to the new final rolling dimension; and
- in the second temporal phase (II) when viewed in the rolling direction:

rolling of the rolling material to the new final rolling dimensions by sequential driving of the pass changes in the rolling mill stands as far as provided for by the second load redistribution.

The feature according to which " . . . no pass change is provided for the last of the rolling mill stands" means that the size of the roll gap of the last rolling mill stand in the first temporal phase remains unchanged compared to its size at the start of the first temporal phase, due to its last setting during the previous rolling.

The term "final rolling dimension" means the final rolling thickness or final rolling width of the rolling material at the outlet of the last rolling mill stand of the rolling line.

The term "rolling mill stand" means an active rolling mill stand that actively changes the dimensions, i.e. the thickness or width, of the rolling material by applying force. There are two variants of the term "active." An active rolling mill stand can change its roll gap dynamically, i.e. during a time interval with an adjusting cylinder traverse speed, or its roll gap is statically and firmly set. The first case is referred to below as a "dynamic rolling mill stand" and the second case is referred to below as a "static rolling mill stand." In both cases, there is a change in the dimensions, i.e. the thickness or width, of the exiting rolling material compared to the dimensions of the entering rolling material. In this respect, only active rolling mill stands of the rolling line are involved in processing the rolling material with regard to the desired new final dimension. That is, if no special statement is made about a rolling mill stand, it is an active rolling mill stand.

This does not exclude the possibility of further inactive rolling mill stands following/standing in the rolling line, but which do not (or no longer) influence the (final) dimensions of the rolling material, in particular do not exert any force on the rolling material. The inactive rolling mill stands can be upstream, intermediate or downstream of the active rolling mill stands in the rolling line. The method for operating a rolling line only starts with the first active rolling mill stand in the rolling line.

The term "rolling line" can mean a plurality of roughing rolling mill stands or a finishing rolling line with a plurality of finishing rolling mill stands or a combination of both.

The term "wedge" refers to a change in thickness or width rolled by a rolling mill stand over a limited (strip) portion of the rolling material. A wedge is created because the rolling material is moved through the roll gap at a transport speed for the duration of a pass change. The wedge can have a positive or negative slope when viewed in the direction of mass flow. In other words, a wedge is understood to be a wedge that is moved from a smaller exit thickness to a larger exit thickness and vice versa. The wedge can be physically driven and designed to be linear or non-linear; this depends on the temporal progression of the adjusting cylinder traverse speed of the adjusting cylinders of the rolling mill stand to change the roll gap and the simultaneous transport speed of the rolling material through the roll gap in each case.

The term "pass change" can mean a decrease or increase in the passes, i.e. a reduction or enlargement of the rolling gap and thus a decrease or increase in the thickness or width of the rolling material.

The term "sequential method" also includes leaving the roll gaps of static rolling mill stands at their previous roll gap sizes if the new roll gap sizes of such rolling mill stands remain unchanged in accordance with the load redistribution. The roll gap settings of these rolling mill stands are then static. However, such rolling mill stands are nevertheless active, because they also contribute to the goal of the new final rolling dimension by statically changing the dimensions of the rolling material, even if they do not generate a wedge in the rolling material due to the static setting of their roll gap.

The method feature according to which wedges are formed in the first temporal phase "up to M−1" is explained by the fact that, in this phase at least, the last rolling mill stand remains unchanged in its roll gap size, i.e. does not form a wedge. This is mandatory for the last rolling mill stand. In addition, the load distribution for the first temporal phase can also provide that other of the M rolling mill stands do not drive a pass change and therefore do not form any wedges.

The method is typically carried out as part of or within the framework of an ongoing rolling process. During the ongoing rolling process, an instruction is issued that the current (previously) final rolling dimension is to be changed to a new final rolling dimension. The specified first and second load redistribution are then determined. Both load redistributions are designed with regard to the desired final dimension and with regard to the most even load possible on the rolling mill stands involved. The most even load possible means the most even wear of the rollers in the rolling mill stands. At an initial point in time to, the first load redistribution is then started during the rolling process. In this respect, the initial point for the method is the static settings of the roll gap of the rolling line at point in time to.

In the first temporal phase, traditional wedge-on-wedge rolling is carried out, but with the special feature that, in this first temporal phase, the previous final rolling dimension remains unchanged in the last rolling mill stand. The sequential driving of the pass changes in the rolling mill stands, except for the last rolling mill stand, to intermediate roll gap sizes in accordance with the first load redistribution serves to achieve intermediate dimensions with the rolling material. In this respect, the first temporal phase forms an intermediate stage on the path to a roll gap and dimension distribution, as will be required to achieve the final dimension at the outlet of the last rolling mill stand. The pass changes in the first phase are typically smaller than in the prior art, where, as mentioned above, no second phase is provided, but the desired new final dimension is generated in just a single phase by wedge-on-wedge rolling. The load redistribution for the first temporal phase is carried out in such a manner that the load and thus the wear of the rollers in all active rolling mill stands involved is equalized and minimized. This also applies to the load redistribution for the second temporal phase.

As a result of the driven changes in the pass patterns with the rolling mill stands, wedge formation occurs in the rolling material. Due to the wedge-on-wedge rolling, the wedges generated by the individual dynamically operated rolling mill stands lie on top of one another. They can be of different lengths. Advantageously, however, the wedges generated in the first temporal phase are smoothed again at the end of the first phase by the last static rolling mill stand, because the last static rolling mill stand does not drive a pass change, i.e. its roll gap size remains statically set. This results in the great advantage that no wedge-shaped rolling material is generated at the end of the first phase. The exiting rolling material has at least one changed intermediate dimension compared to the previous final dimension. The changed intermediate dimensions are generated in the rolling material by the rolling mill stands of the rolling line, except by the last rolling mill stand, which remains at its previous setting. Given that the last rolling mill stand remains at its previous setting, the dimensions of the exiting rolling material are constant. And in this respect, the part of the strip portion processed by the first temporal phase is in principle usable and does not have to be discarded as scrap.

In addition, in the first temporal phase, mass flow or process disruptions advantageously only occur comparatively rarely and—if at all—then only to a moderate extent. The reason for this is as follows: The intermediate roll gap sizes approached and the intermediate dimensions realized as a result are considerably smaller than in the prior art. The wedge can also be longer and thus the process disruption smaller.

In the time intervals in which the rolling mill stands drive the specified dynamic pass changes, the wedges are created in the rolling material and the exit speed of the rolling material from the rolling mill stands changes. Upon the opening of the rolling mill stands, they are decelerated; upon a closing, they are accelerated due to the constancy of the mass flow. At the end of the respective traverse time interval, i.e. after deceleration or acceleration has been carried out, the exit speed remains constant in each case. This applies in principle to any dynamic driving of pass changes in both the first and second temporal phase. Therefore, the speed of the strip portion at the start of the second temporal phase is also constant if the second temporal phase follows the first phase.

In the second temporal phase of the rolling method, the roll gap of at least the last rolling mill stand of the rolling line is driven to the new final rolling dimension by a second pass change. These and optionally further pass changes are carried out in accordance with a previously defined second load redistribution, which again aims to ensure that the load on all rolling mill stands involved is as uniform as possible. However, unlike the first load redistribution, the second load redistribution takes into account the dynamic driving of the pass change on the last rolling mill stand to the new final dimension for the rolling material. A large part of the necessary changes to the dimensions of the rolling material with regard to the new final dimension have already been realized in the first temporal phase, such that, in the second temporal phase, only a comparatively small remaining change to the dimension/pass change has to be carried out in order to achieve the new final dimension. Therefore, the remaining small residual change in dimension can be carried out on a relatively short wedge-shaped strip portion compared to the prior art. Therefore, such strip portion is also comparatively short, because the maximum traverse speed of the adjusting cylinders of the last rolling mill stand can be selected and this results in a maximum change in the exit speed of the rolling material from the last rolling mill stand in the second phase. The traverse speed is not limited by the limited acceleration capability of the downstream rolling mill stand; there is typically simply no such downstream rolling mill stand. Only the coiler would still be a limiting element here. The shorter wedge-shaped strip portion for the transition to the new final dimension advantageously means, on the one hand, a reduction in scrap material. On the other hand, the time required to realize the last decrease in the number of passes in the second temporal phase is also comparatively short due to the high possible adjusting cylinder traverse speed. This advantageously results in an increase in production throughput. The only remaining small and short-term residual change in dimension—due to only a brief change in the exit speed of the rolling material—advantageously also leads to a temporal reduction in disruptions in the cooling section downstream of the last rolling mill stand and thus to a reduction in disruptions in the quality/material properties of the rolling material.

In the first and second temporal phases, in each case different rolling mill stands are typically operated dynamically from the set of all rolling mill stands in the rolling line. However, some of the same rolling mill stands can also be operated dynamically. The last rolling mill stand is actively involved in both phases; statically operated in the first phase and dynamically operated in the last phase.

In accordance with a first exemplary embodiment, it is not provided that the first and/or second load redistribution necessarily provides for a pass change for each rolling mill stand of the rolling line. Rather, no changes to the pass plan can be provided for individual rolling mill stands. Such rolling mill stands are then operated statically, i.e. their roll gaps remain unchanged.

In accordance with a further exemplary embodiment, the rolling material that is rolled is an "endless" casting strand, by means of which the rolling line is coupled to a casting machine upstream in the rolling direction. The term "endless" means that the rolling material is cast in the casting machine in the form of an endless casting strand, without being subsequently cut transversely.

Alternatively, the rolling material can also be a slab, which is produced by portioning, i.e. at least simple transverse division of the continuously cast strand. Due to the transverse division, the casting machine and the rolling line are then no longer coupled together. This results in the advantage that the rolling material can be rolled in the rolling line at a higher speed than the casting machine would allow due to its comparatively low casting speed.

The continuous casting strand or the slab separated from the continuously cast casting strand can contain one or more strip portions on which the method is carried out separately with the first and second temporal phases in each case. If the slab contains a plurality of strip portions, it is also referred to as "semi-endless" rolling. A strip portion preferably corresponds to a coil length to be wound onto a coil later. If, on the other hand, the slab only comprises one strip portion, which typically corresponds to only one coil length, this is referred to as batch rolling.

In accordance with a further exemplary embodiment, the roll gaps are successively opened if the new final dimension is larger than the previous final dimension. Of course, this assumes that the dimensions of the rolling material were correspondingly larger. Alternatively, the roll gaps are closed in order to reduce the final rolling dimensions of the rolling material.

In principle, it is advantageous if the adjusting cylinders in the rolling mill stands are driven at a constant traverse speed—apart from an initial acceleration and deceleration—to open or close the roll gaps for wedge formation in the rolling material. In conjunction with an exit speed proportional in each case to the thickness at which the rolling material exits a rolling mill stand, this advantageously results in an approximately linear wedge in the rolling material. If the transverse speeds of the adjusting cylinders are not constant and/or are in conjunction with non-constant exit speeds of the rolling material for the same rolling mill stand, the wedges resulting in the rolling material can also be non-linear, i.e. they can then have an uneven, for example curved surface.

Typically, the first and second phases follow one after the other with a pause. Alternatively, the pause can also be omitted, such that the first and second temporal phases immediately follow one another. Alternatively, it is also possible for the first and second phases to overlap in such a manner that the second phase starts before the first phase has ended. The last two alternatives advantageously lead to a shortening of the implementation time for the method and to a shortening of the length of the transition strip portion required for changing the final dimension.

Advantageously, the application of the method is carried out in a hot rolling line and with hot strip as the rolling material, because the change in the roll gap sizes/the change in the dimensions of the rolling material can then be carried out relatively easily, i.e. without too much force, due to the high temperature. However, this does not exclude the use of the method for the cold rolling of rolling material.

The above-mentioned object of the disclosure is further achieved by a computer program product. The advantages of this computer program product correspond to the advantages mentioned above with reference to the disclosed method. The term "computer program product" also includes software burned into memory chips and software in specially manufactured ICs (integrated circuits). The memory chips and/or the ICs are then the "memories of a digital computer."

BRIEF DESCRIPTION OF THE DRAWINGS

FIG. 5 shows a comparison of wedge lengths for different operating modes of rolling mill stands.

DETAILED DESCRIPTION

In all figures, the same elements are designated with the same reference signs.

Figure 1:
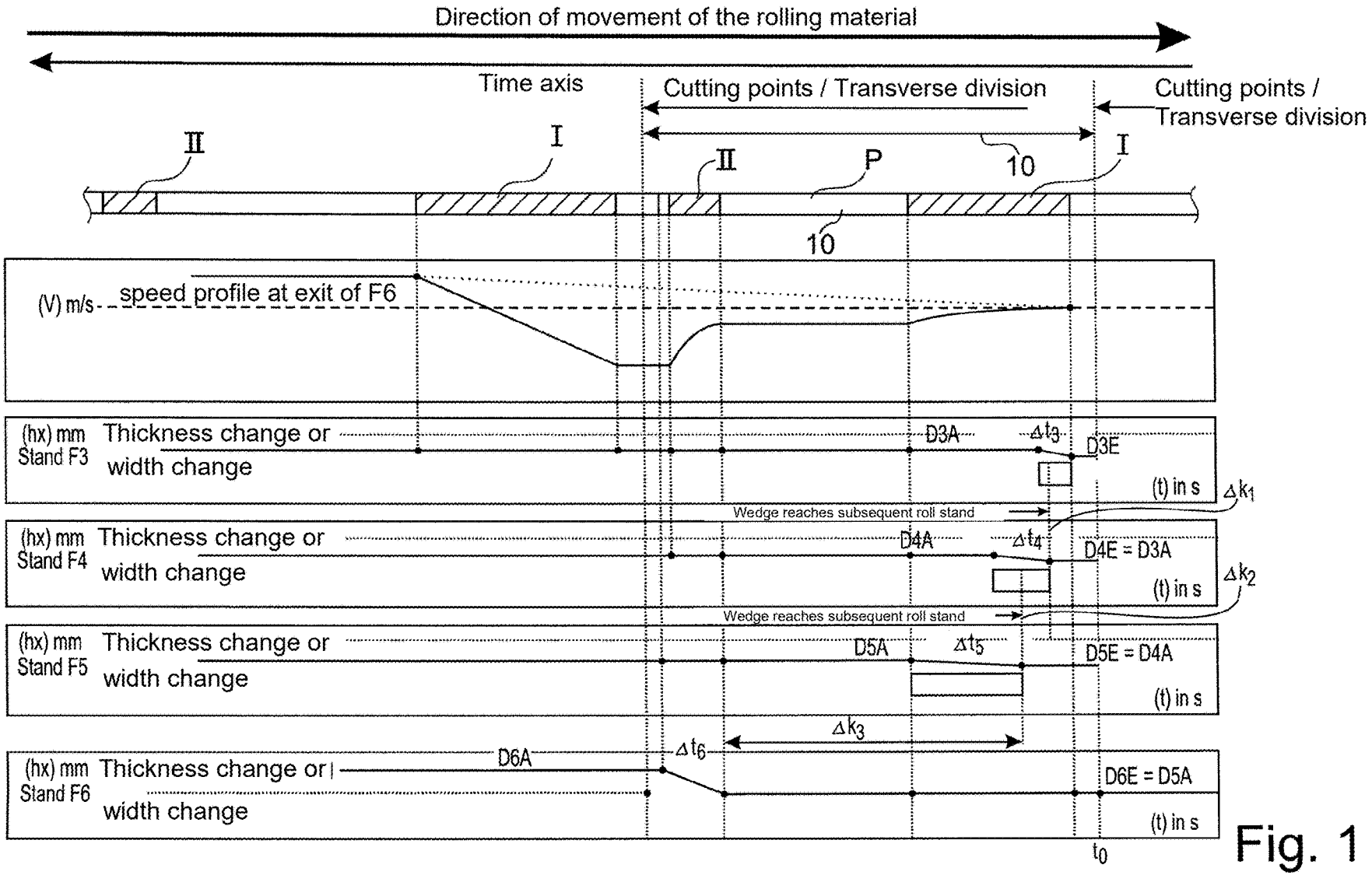
FIG. 1 illustrated the method for operating a rolling line in accordance with a first exemplary embodiment.

FIG. 1 illustrates the sequence of the individual steps of the method for operating a rolling line on the individual rolling mill stands of a rolling line. The rolling mill stands of the rolling line are designated F1 to F6, wherein the rolling mill stands F1 and F2, i.e. the first two rolling mill stands of the rolling line, are not actively involved in carrying out the method in accordance with the example in FIG. 1 and are therefore not mentioned in FIG. 1. In FIG. 1, the rolling direction, i.e. the direction of movement of the rolling material through the rolling mill stands F1 to F6, runs from left to right. In contrast, the time axis runs in the opposite direction from right to left.

The implementation of the method relates to a single (virtual) strip portion 10 defined at least on the software side, marked with the black horizontal double arrow in FIG. 1. This strip portion is created by virtual transverse division, or later real transverse division, before the coiler, of a cast endless casting strand at two different points in time, as marked in FIG. 1. The two cuts not only create the specified strip portion, but also separate the rolling line from an upstream casting machine that produces the endless casting strand.

In relation to the one (virtual) strip portion, the method is carried out in two separate phases, a first temporal phase I and a second temporal phase II, which here, by way of example, follow one another in time with a pause P. The total number of M active rolling mill stands in the exemplary embodiment shown in FIG. 1 amounts to four; it comprises the rolling mill stands F3, F4, F5 and F6 of a rolling line. Of these, the rolling mill stands F3, F4 and F5, but not the rolling mill stand F6, are active in the first temporal phase I. The rolling mill stand F6 is only active in the second temporal phase II. Such rolling mill stands are all operated dynamically here by way of example. Thereby, they are not driven simultaneously, but are driven sequentially from their initial roll gap sizes to new roll gap sizes. The pass changes (ordinate $h_x$) are carried out in the first temporal phase I in accordance with a previously determined first load redistribution and in the second temporal phase II in accordance with a previously determined second load redistribution. Both load redistributions are determined by a process model with regard to a desired new final dimension of the rolling material and with regard to the most even possible abrasion of the rolls of the rolling mill stands. The pass changes are carried out during the rolling of the rolling material. As a result of the driven pass changes, wedges form in the rolling material.

In the exemplary embodiment shown in FIG. 1, the desired new final rolling dimension, here, by way of example, the new desired final rolling thickness, for the strip portion 10 of the rolling material under consideration here is larger than the final rolling thickness for previously rolled strip portions. In this respect, the roll gaps of the rolling mill stands involved are in each case opened here.

It can be seen in FIG. 1 that during the first temporal phase I, the rolling mill stand F3 is the first active rolling mill stand of the rolling line to open its roll gap for a pass change over the time interval $\Delta t_3$, starting from point in time $t_1$; see the ramp-shaped increase in FIG. 1. As a result of the opening of the roll gap, the intermediate dimension of the passing rolling material increases as desired from an initial thickness D3E at the inlet of the rolling mill stand F3 to a thickness D3A at the exit of the rolling mill stand F3. This intermediate exit thickness D3A corresponds to the entry thickness D4E at the inlet of the rolling mill stand F4. The roll gap of the rolling mill stand F4 is also opened further during the time $\Delta t_4$ for a pass change, with the result that the thickness of the rolling material at the outlet of the rolling mill stand F4 increases to the new intermediate thickness D4A. In accordance with wedge-on-wedge rolling, the rolling mill stand F4 advantageously already starts to open its roll gap if the start of the first wedge produced by the previous rolling mill stand F3 arrives at its entrance, i.e. at the entrance of the rolling mill stand F4. This is typically offset temporally by the time interval $\Delta k_1$. It can also be seen in FIG. 1 that the opening of the roll gap of rolling mill stand F3 is not yet fully completed when the rolling mill stand F4 has already started to open its roll gap; the following therefore applies: $\Delta k_1 < \Delta t_3$.

The opening to in each case new intermediate values for the roll gaps in accordance with the previously calculated first load redistribution for the first temporal phase is then also repeated on the rolling mill stand F5.

With all three rolling mill stands F3, F4 and F5, the roll gap in the exemplary embodiment shown in FIG. 1 is opened further and further, such that the resulting intermediate rolling dimensions in each case of the rolling material at the outlets of the rolling mill stands increase successively. This is by no means necessarily always the case, as described at the beginning. Specifically, however, it has already been stated that the inlet thickness at the rolling mill stand F4 increases from the thickness D4E=D3A to D4A>D4E. Similarly, the final rolling thickness of the rolling material increases again as it passes through the rolling mill stand F5 if its roll gap is also opened further during a time interval $\Delta t_5$; the final dimension of the rolling material then increases from D5E=D4A to D5A>D5E. The adjustment time that the rolling mill stands F4 and F5 require for the respective opening of their roll gaps amounts to $\Delta t_4/\Delta t_5$. The individual rolling mill stands F3 to F5 in each case generate wedges in this manner, which are all superimposed in the rolling material (wedge-on-wedge). As a result, the desired transition from the previous final rolling dimension of the rolling material to the new final rolling dimension can be realized in a comparatively short portion of the strip portion.

The intermediate thickness D5A is input into the rolling mill stand F6 as the inlet intermediate rolling dimension D6E. The rolling mill stand is operated statically in the first temporal phase I, i.e. its roll gap remains unchanged. However, given that the size of the roll gap at F6 is typically different from D5A, the rolling material also undergoes a change in its dimensions in the first temporal phase in the rolling mill stand F6. However, this change in dimension is not associated with a wedge formation, because the roll gap of F6 is not changed over a time interval. The exit speed of the rolling material and its intermediate dimension at the end of the first temporal phase are constant in time. With respect to the advantages associated with this, reference is made to the general part of the description above.

Given that the rolling material has not yet reached its desired new final dimensions at the end of the first temporal phase, a second temporal phase II follows. In the example shown in FIG. 1, only the rolling mill stand F6 is actively involved. By no means is this always the case. In fact, other rolling mill stands, which can be operated statically or dynamically, can also be involved in the second temporal phase. The last rolling mill stand F6 is now operated dynamically—unlike in the first temporal phase. That is, a pass change is driven during a time interval $\Delta t6$. Specifically, the roll gap of F6 is opened from its initial opening D6E to the new final dimension D6A here, by way of example, due to the pass change specified by the second load redistribution. The resulting wedge is very short compared to the prior art. In addition, the actuating cylinders of F6 can be driven very rapidly, as shown in the top line of FIG. 1. As a result, the time interval $\Delta t_6$ can be kept very short. With respect to the advantages associated with this, reference is also made to the general part of the description.

Finally, FIG. 1 shows the speed profile of the rolling material at the outlet of the last rolling mill stand F6 below the representation of the strip. In the first temporal phase I, the exit speed is lower because the frames F3-F5 open during their pass changes and the mass flow must be maintained. In accordance with FIG. 1, the rolling mill stand F6 does not contribute to a change in the dimensions of the rolling material in the first temporal phase, nor does it contribute to a change in its exit speed.

In the second temporal phase II, F6 alone is opened. Again due to the conservation of the mass flow, its exit speed therefore decreases during the time interval $\Delta t_6$. After this, the exit speed of the rolling material at the outlet of F6 remains constant.

Figure 2:
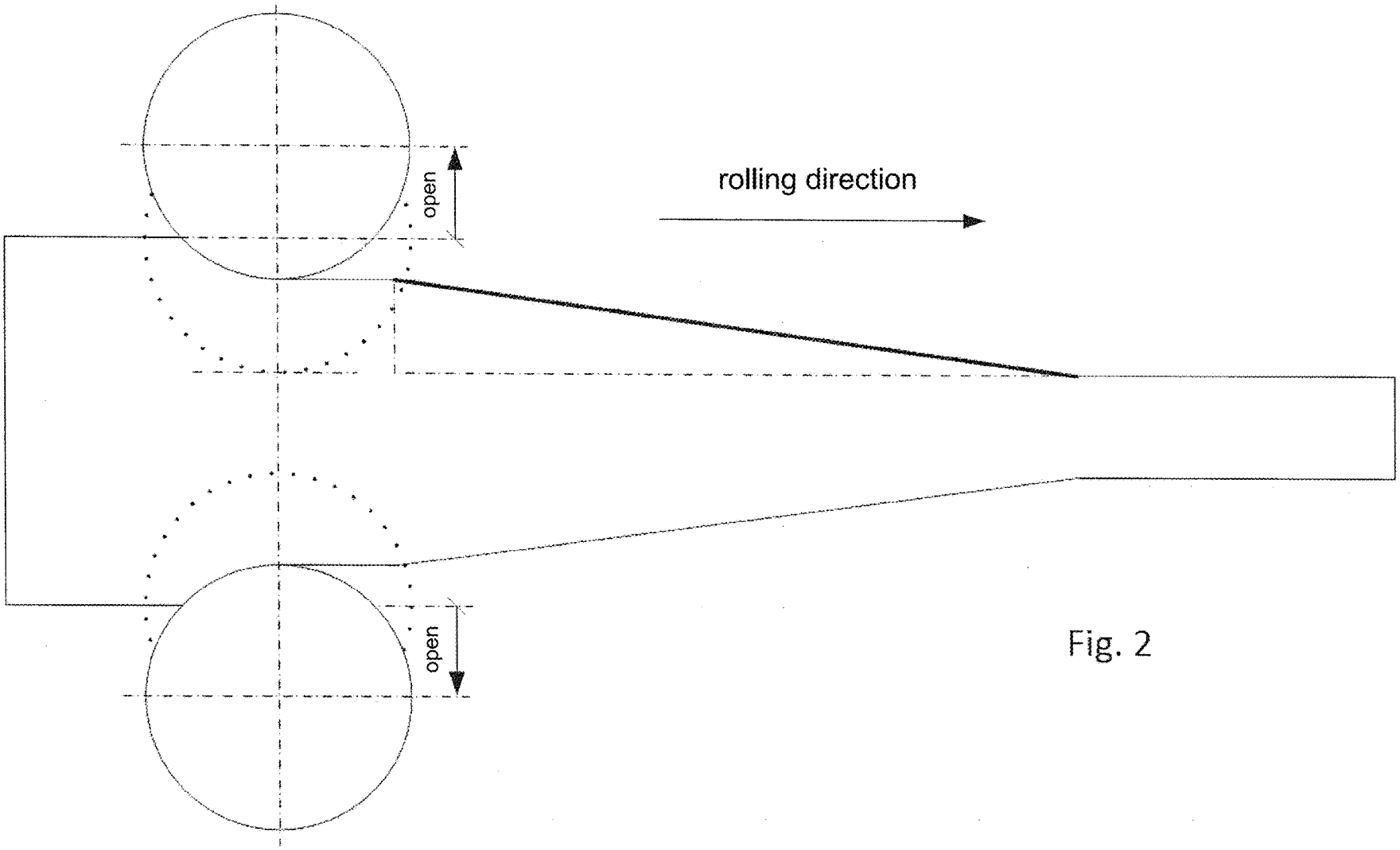
FIG. 2 shows a wedge with a negative slope in the rolling direction to increase the dimensions of the exiting rolling material.

FIG. 2 illustrates a roll wedge with a negative slope, as it can be created by opening the rolling mill stands in accordance with FIG. 1.

Figure 3A:
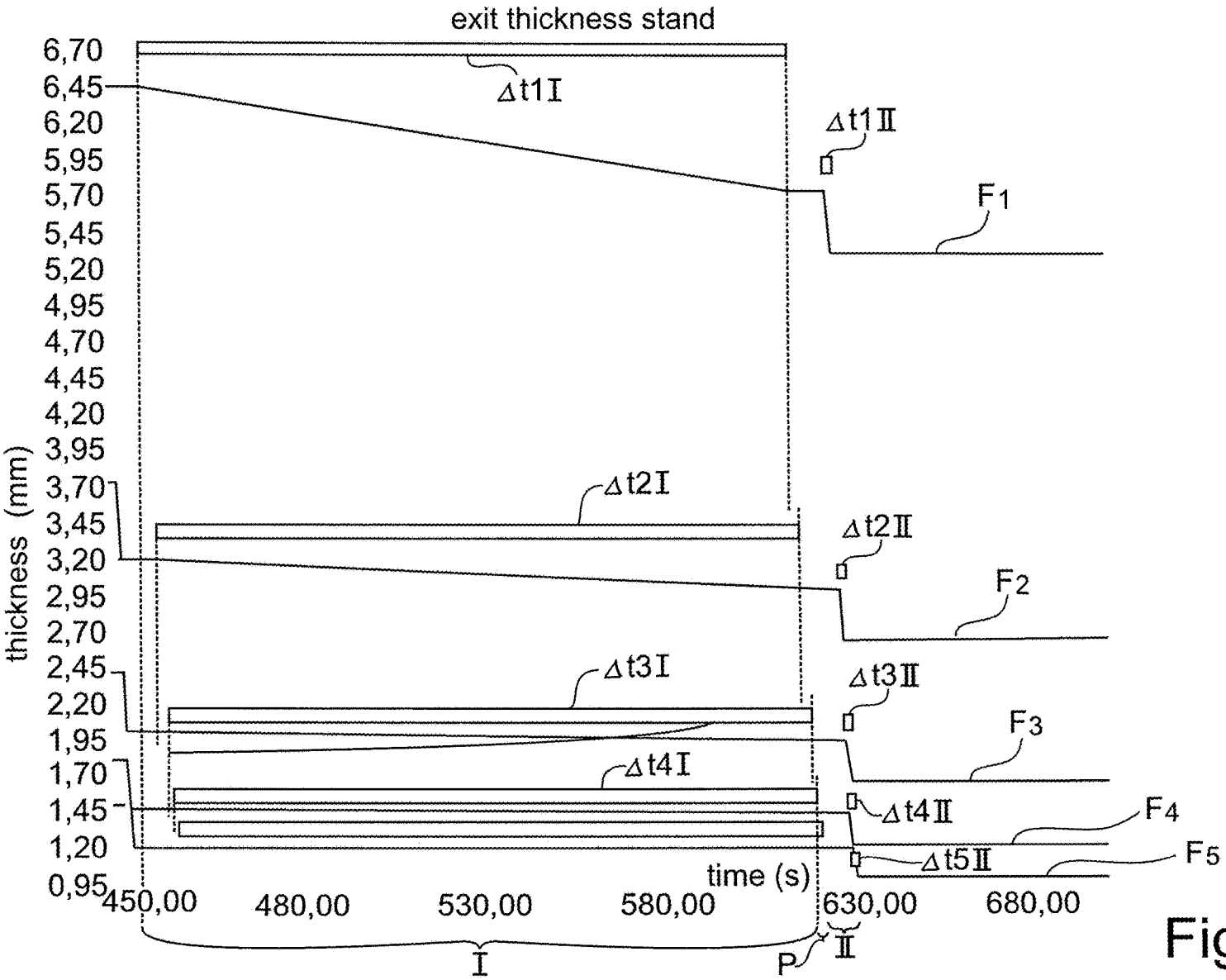
FIGS. 3*a* and 3*b* show a second exemplary embodiment of the method for operating a rolling line.
Figure 3B:
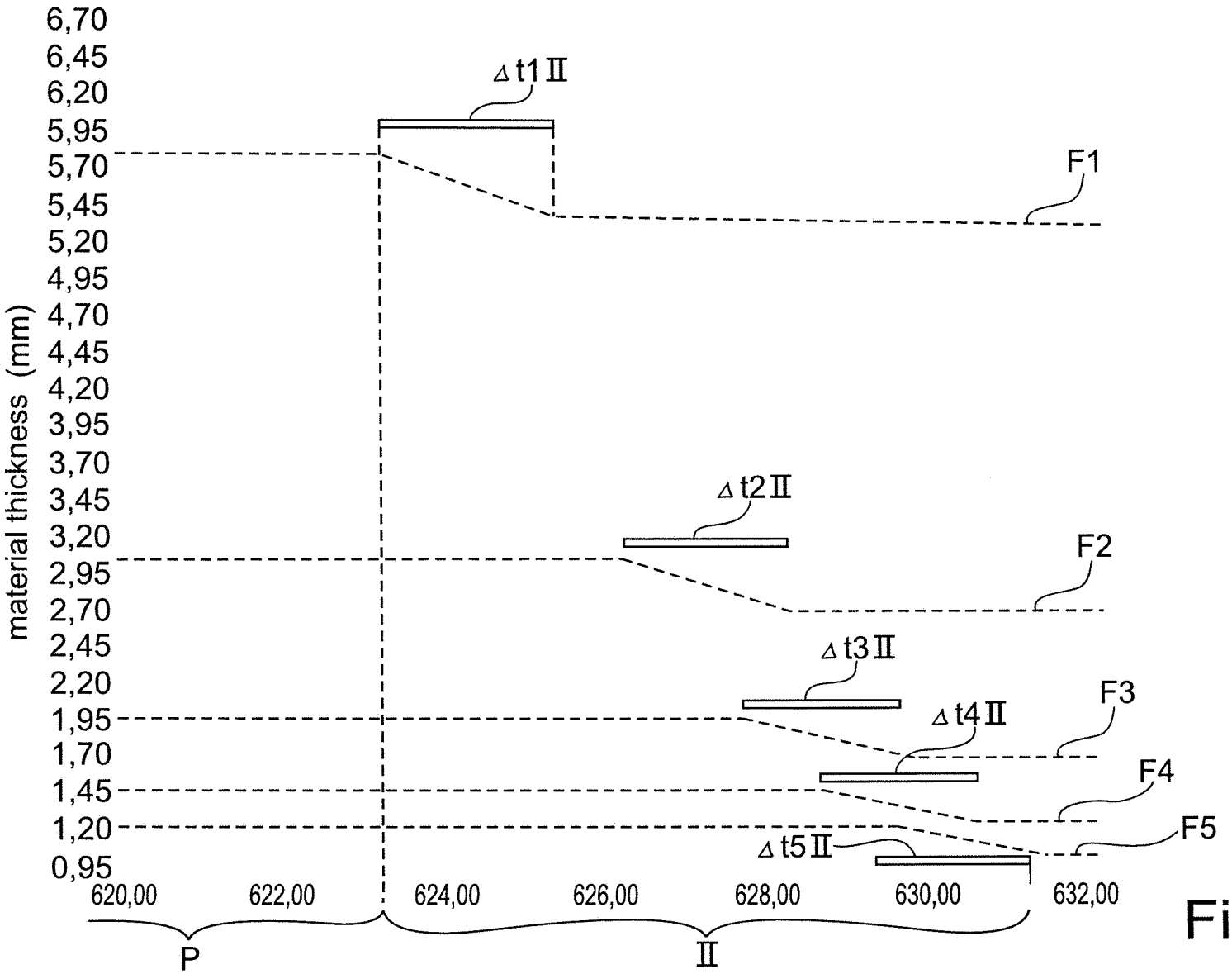

FIGS. 3*a* and 3*b* illustrate a second exemplary embodiment of the method for operating a rolling line, with which, however, the roll gaps of the rolling mill stands involved are not opened but closed in order to reduce the thickness of the rolling material. In this example, the rolling mill stands F1 to F5 are involved in the rolling of the rolling material, both during the first temporal phase I and during the subsequent second temporal phase II. The stands F1 to F4 are operated dynamically in the first temporal phase I, i.e. they drive the pass changes assigned to them by a first load redistribution in each case in the time intervals $\Delta t_1$I, $\Delta t_2$I, $\Delta t_3$I and $\Delta t_4$I. In contrast, the fifth rolling mill stand F5 is operated statically in the first temporal phase I, i.e. its roll gap remains firmly set in the position that the roll gap already had prior to the start of the first temporal phase. At the end of the first temporal phase I, no wedge is realized in the rolling material by the rolling mill stand F5 and all wedges generated by the previous rolling mill stands, as shown in FIG. 3*a*, are flattened by the stand F5. Therefore, the exit thickness of the rolling material at the exit of the rolling mill stand F5 is constant in the first temporal phase I.

The first temporal phase is followed by the second temporal phase II, here, by way of example, with a short pause P. In this second temporal phase II, all rolling mill stands F1 to F5 are here, by way of example, operated dynamically, i.e. in each case they roll a wedge in the time intervals $\Delta t_1$II, $\Delta t_2$II, $\Delta t_3$II, $\Delta t_4$II and $\Delta t_5$I, wherein the wedges in each case are superimposed in the rolling material (wedge-on-wedge rolling), see FIG. 3*a* and enlarged in FIG. 3*b*. Unlike in the first temporal phase I, the rolling mill stand F5 is now also operated dynamically. Specifically, the second load redistribution provides that the rolling mill stand F5 drives a pass change, wherein its roll gap is closed from its static setting in the first temporal phase I to the new smaller final roll thickness. Due to this dynamic mode of operation of the rolling mill stand F5, a short wedge-shaped transition to the new final rolling thickness occurs in the rolling material. However, this wedge-shaped part of the strip portion 10 changed overall by the method is considerably shorter compared to the prior art. This means less scrap material and the transition to the new final roll thickness is carried out in a shorter time.

Figure 4:
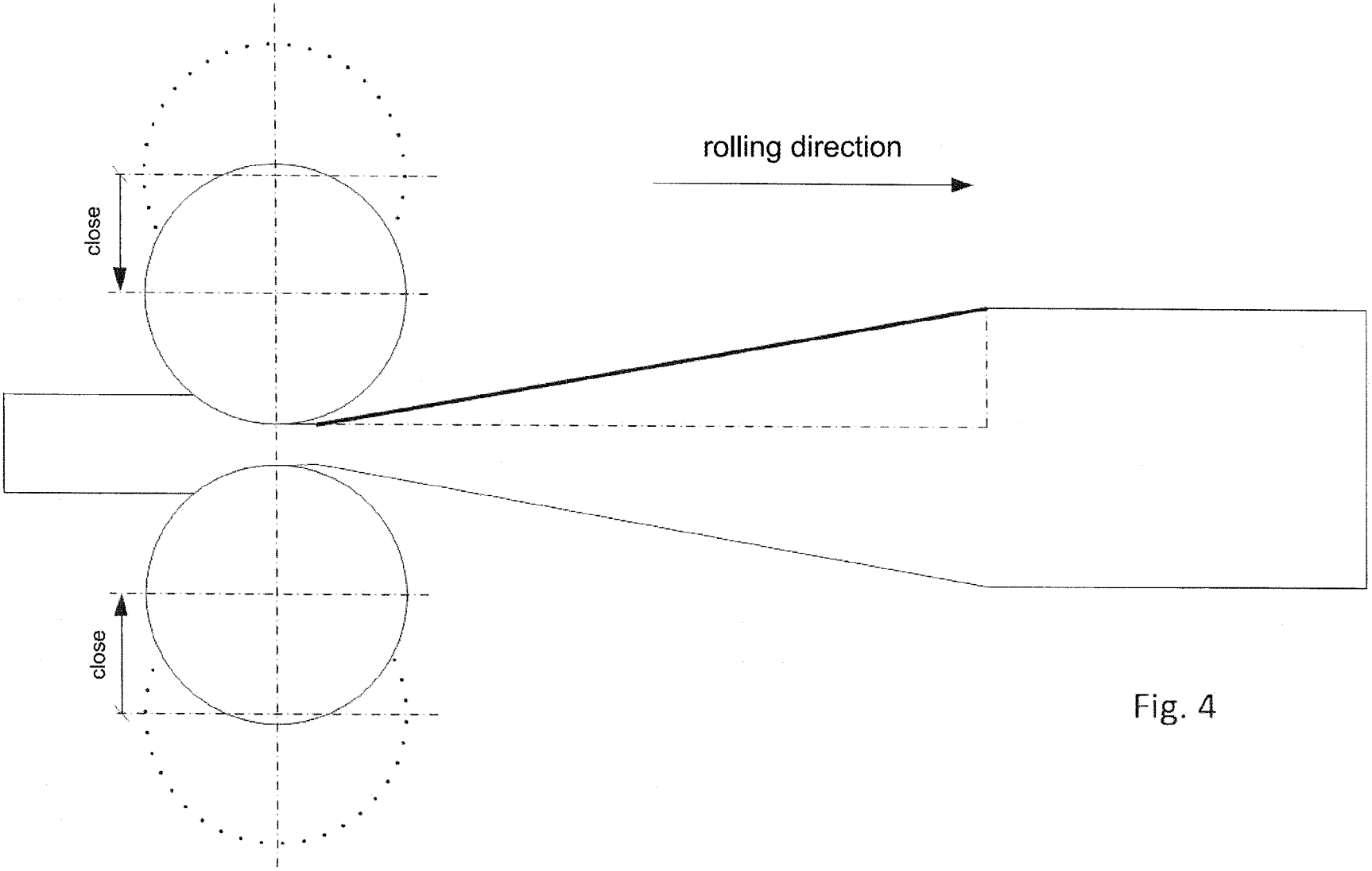
FIG. 4 shows a wedge shape with a positive slope when viewed in the rolling direction, as produced upon carrying out the method in accordance with FIG. 3 *a*+*b*.

FIG. 4 illustrates the formation of a wedge with a positive slope in the rolling direction, as it is generated by the rolling mill stands F1 to F5, in particular in the second temporal phase II, within the framework of the second exemplary embodiment in accordance with FIGS. 3*a* and 3*b*.

FIGS. 2 and 4 in each case show linear wedges. Alternatively, the wedge surface could also be designed to be curved/bent, depending on the temporal progression of the adjusting cylinder traverse speeds and the temporal progression of the exit speeds of the rolling material from the rolling mill stands.

FIG. 5 shows a comparison of wedge lengths as they exit the last stand F5 of a rolling line if the rolling mill stands F1 to F5 of the rolling line are operated in different operating modes. In addition to the same rolling line with the same rolling mill stands F1 to F5, the same presetting of the rolling mill stands is also assumed with all three exemplary embodiments. That is, in concrete terms: In each case, the rolling mill stand F1 is preset to a roll gap size of 16 mm, the rolling mill stand F2 to a roll gap size of 8 mm, the rolling mill stand F3 to a roll gap size of 4 mm, the rolling mill stand F4 to a roll gap size of 2 mm and the rolling mill stand F5 in each case to a roll gap size of 1 mm (exit thickness initial state). The stands F1 to F5 are preset in such a manner that a removal/thickness reduction of the rolling material by 50% is carried out at each stand. In addition to this initial state, all three exemplary embodiments also specify that the initial thickness of the rolling material should be reduced from 16 mm to 0.8 mm at the outlet of the last rolling mill stand F5. This is the extent of the initial situation.

The first example shown in FIG. 5 relates to the wedge-on-wedge rolling known from the prior art. Starting from their specified initial states, the stands are in each case closed by the amount indicated in the "Delta" line in accordance with this prior art. The resulting outlet thickness can be seen in the penultimate line.

The table for the exemplary embodiment in accordance with the prior art shows that, with the specified thickness reduction at the outlet of the last rolling mill stand F5, the rolling material exits with a wedge length of 16 m. This large exit wedge length is unfavorable, because it has to be discarded as scrap material in case of doubt. The present method aims to reduce such wedge length, which is illustrated by the two examples of extreme cases 1 and 2.

In contrast to the prior art, a distinction is made in the two exemplary embodiments between a first temporal phase I and a second temporal phase II. In each case, the exit thicknesses at the respective stands and the respective thickness reduction in the individual phases are indicated for these two phases, in each case designated Delta in the two tables for the exemplary embodiments. The substantial method step in the two exemplary embodiments, in contrast to the prior art, is that the rolling mill stand F5 remains in its initial state during phase I, in this case 1 mm. Accordingly, the delta in phase I amounts to 0 mm in each case. Only at the end of the second temporal phase II is the last rolling mill stand moved in each case dynamically from its initial position to the desired new final dimension, in this case 0.8 mm. The associated delta for the stand F5 in temporal phase II therefore amounts to 0.2 mm for both extreme cases, as indicated.

The extreme case 1 is extreme in that the stands F1 to F4 are used in the same manner as the prior art, but the frame F5 remains in its initial state. In the second temporal phase, the frames F1 to F4 remain at their settings corresponding to the first temporal phase I and only frame F5 moves as explained above. The result is an ultra-short wedge length of just 0.5 m at the exit of the frame F5 compared to the prior art, where the exit length amounts to 16 m.

The extreme case 2 provides for the successive closing of each of the individual stands F1 to F5, with the result that the exit length at the end of the second phase at the outlet of the last rolling mill stand F5 amounts to 8 m in this case.

Both extreme cases illustrate in this respect that, with the disclosed method, the object of the disclosure, namely to achieve a shortening of the exit wedge lengths at the last rolling mill stand, can be well achieved; the exit wedge lengths are shortened by a quite considerable factor in each case compared with the prior art: in the extreme case 1 the factor amounts to 16:0.5=32 and in the extreme case 2 it amounts to 16:8=2.

LIST OF REFERENCE SIGNS

I First temporal phase
II Second temporal phase
10 Strip portion
P Pause
$h_x$ Thickness of the rolling material/opening path of a rolling mill stand/pass size

The invention claimed is:

1. A method for operating a rolling line having a total number (M) of rolling mill stands arranged one behind another in a rolling direction, for rolling a rolling material from a previous final rolling dimension to a new final rolling dimension, comprising:

determining a first load redistribution for a first temporal phase (I) in a form of first pass changes for a subset of the rolling mill stands, the subset comprising fewer than all of the rolling mill stands, with regard to the new final rolling dimension;

in the first temporal phase (I), when viewed in the rolling direction, sequentially driving the first pass changes in the rolling mill stands corresponding to the first load redistribution during the rolling of the rolling material and forming up to M−1 wedges in the rolling material, wherein each wedge-rolling rolling mill stand of the rolling mill stands—except for a first rolling mill stand—starts to roll a wedge caused by an associated one of the first pass changes in the rolling material at a point where a preceding rolling mill stand of the rolling mill stands has also started to roll a wedge, such that wedges rolled in the first temporal phase are superimposed in the rolling material, and wherein the first load redistribution provides no pass change for a last of the rolling mill stands;

determining a second load redistribution for a second temporal phase (II) in a form of second pass changes for at least the last of the rolling mill stands with regard to the new final rolling dimension; and in the second temporal phase (II), when viewed in the rolling direction, rolling the rolling material to the new final rolling dimension by sequentially driving the second pass changes in at least the last of the rolling mill stands as provided for by the second load redistribution.

2. The method according to claim 1, wherein the second load redistribution does not provide for a pass change for one or more of the rolling mill stands.

3. The method according to claim 1, wherein the second load redistribution provides for a decrease in passes for some of the rolling mill stands and no increase in passes for other of the rolling mill stands.

4. The method according to claim 1, wherein the rolling material is an endless casting strand, by which the rolling line is coupled to a casting machine upstream in the rolling direction.

5. The method according to claim 1, further comprising casting an endless strand in a casting machine upstream of the rolling line, and dividing the endless strand transversely after leaving the casting machine to thereby produce a slab as the rolling material, whereby the rolling line is decoupled from the casting machine.

6. The method according to claim 1, wherein the rolling material has at least one strip portion in which the method with the first and the second temporal phase is carried out separately, such that the strip portion represents a transition region in which the rolling material transitions from the previous final rolling dimension to the new final rolling dimension.

7. The method according to claim 1, wherein the driving of the first pass changes comprises an opening of roll gaps to increase the new final dimension of the rolling material or a closing of roll gaps to reduce the new final dimension of the rolling material.

8. The method according to claim 1, wherein adjusting cylinders in the rolling mill stands are moved at a constant or non-constant adjusting cylinder traversing speed—apart from an initial acceleration and a deceleration—for driving the first pass changes.

9. The method according to claim 1, wherein the second temporal phase (II) immediately follows the first temporal phase (I) or follows the first temporal phase (I) with a pause.

10. The method according to claim 1, wherein the first temporal phase (I) overlaps the second temporal phase (II) in time such that the second temporal phase (II) starts before the first temporal phase (I) has ended.

11. The method according to claim 1, wherein the rolling mill stands are hot rolling line stands for hot rolling the rolling material.

12. The method according to claim 1, wherein the new final rolling dimension is a final rolling thickness and the rolling mill stands are thickness reduction rolling mill stands.

13. The method according to claim 1, wherein each of the rolling mill stands is an upsetting press or an upsetting rolling mill stand and the rolling is an upsetting process for reducing a final roll width as the new final rolling dimension of the rolling material.

14. The method according to claim 1, wherein the rolling line is formed by a plurality of roughing rolling mill stands or by a finishing rolling line with a plurality of finishing rolling mill stands, or in that the rolling line also includes roughing rolling mill stands in addition to the rolling mill stands of a finishing rolling line.

15. The method according to claim 1, further comprising loading software code portions into a non-transitory internal memory of a digital computer, the software code portions being executable by the digital computer to cause the digital computer to perform the method.

* * * * *